US008919072B2

(12) United States Patent
Han

(10) Patent No.: US 8,919,072 B2
(45) Date of Patent: Dec. 30, 2014

(54) STRUCTURE FOR CONSTRUCTING A HIGH-RISE BUILDING HAVING A REINFORCED CONCRETE STRUCTURE INCLUDING A STEEL FRAME

(76) Inventor: Bong-Kil Han, Seoul (KR)

( * ) Notice: Subject to any disclaimer, the term of this patent is extended or adjusted under 35 U.S.C. 154(b) by 0 days.

(21) Appl. No.: 13/877,605

(22) PCT Filed: Oct. 26, 2011

(86) PCT No.: PCT/KR2011/008006

§ 371 (c)(1),
(2), (4) Date: Apr. 3, 2013

(87) PCT Pub. No.: WO2012/057510

PCT Pub. Date: May 3, 2012

(65) Prior Publication Data

US 2013/0205707 A1 Aug. 15, 2013

(30) Foreign Application Priority Data

Oct. 28, 2010 (KR) ..... 10-2010-0105834

(51) Int. Cl.

| | |
|---|---|
| ***E04B 1/38*** | (2006.01) |
| ***E04B 1/41*** | (2006.01) |
| ***E04B 1/34*** | (2006.01) |
| *E04B 1/24* | (2006.01) |

(52) U.S. Cl.

CPC ..... *E04B 1/4121* (2013.01); *E04B 1/34* (2013.01); *E04B 2001/2415* (2013.01); *E04B 2001/2448* (2013.01); *E04B 2001/2457* (2013.01); *E04B 1/41* (2013.01); *E04B 2001/2439* (2013.01)

USPC ..... 52/699; 52/649.3; 52/650.2

(58) Field of Classification Search

USPC ..... 52/699, 655.1, 648.1, 649.1, 649.2, 52/649.3, 650.1, 650.2, 742.1, 742.13, 52/653.1, 236.3

See application file for complete search history.

(56) References Cited

U.S. PATENT DOCUMENTS 4,151,694 A * 5/1979 Sriberg et al. ..... 52/665
6,298,630 B1 * 10/2001 VeRost et al. ..... 52/712

(Continued)

FOREIGN PATENT DOCUMENTS

JP 10-280601 10/1998
JP 11-343700 12/1999

(Continued)

*Primary Examiner* — Jeanette E Chapman
*Assistant Examiner* — Daniel Kenny
(74) *Attorney, Agent, or Firm* — Fay Kaplun & Marcin, LLP

(57) ABSTRACT

The present invention relates to a structure for constructing a building including girders and beams which are horizontally and vertically coupled to one another about a column. The structure includes: a gusset plate welded to a side portion of a first girder in a direction crossing a length direction of the first girder for supporting at least one first angle connection for supporting a slab and adjusting a frame assembly position; and a first coupling member including a first bolt and a first nut for coupling the first angle connection to the gusset plate. The first nut is embedded in concrete constituting a core wall or a slab, such that the first angle connection is removable from the gusset plate after concrete is cured in a region corresponding to the first girder. Thus, structural stability in the preconstruction of a slab, efficiency in installing a frame to be subsequently constructed, and efficiency in installing an angle connection for supporting a slab and adjusting a frame assembly position can be ensured. Furthermore, since the angle connection can be easily removed after slab concrete and core concrete are cured, the angle connection can be recycled, thus improving the quality of the building, decreasing the time required for construction and reducing construction costs, and enabling the building to be built more safely.

15 Claims, 11 Drawing Sheets

(56) References Cited

U.S. PATENT DOCUMENTS 7,647,742 B2 * 1/2010 Han ..... 52/741.1
8,056,291 B1 * 11/2011 diGirolamo et al. ..... 52/250

FOREIGN PATENT DOCUMENTS

JP 2009-052302 3/2009
JP 2010-007365 1/2010

* cited by examiner

STRUCTURE FOR CONSTRUCTING A HIGH-RISE BUILDING HAVING A REINFORCED CONCRETE STRUCTURE INCLUDING A STEEL FRAME

TECHNICAL FIELD

The present invention relates to a structure for constructing a high-rise building having a reinforced concrete structure including a steel frame, and more particularly, to a structure for constructing a high-rise building having a steel-framed reinforced concrete structure in which an angle for supporting a slab and adjusting a frame assembly position is capable of being easily installed as well as easily removed after core concrete and slab concrete are cured, and thus, the angle may be recycled to reduce construction costs.

BACKGROUND ART

Generally, a reinforced concrete (RC) construction, a steel-frame (SF) construction, and a steel-framed reinforced concrete (SRC) construction are typically used to construct buildings. In recent years, as buildings are large-sized and high-storied, a combination of three constructions has been widely used.

Furthermore, as buildings are large-sized and high-storied, an earthquake-resistance and wind-resistance design becomes a major issue when constructing the buildings. Therefore, a core portion in which facilities such as an elevator, electric facility, system facility, and a staircase are arranged is firstly constructed using the reinforced concrete construction, and then a main column portion for defining residence spaces is secondly constructed using the steel-frame construction.

FIGS. 1 and 2 show a conventional structure for constructing a building having an SRC structure in which a core is constructed in advance.

In the drawings, the reference numeral 1 indicates a building core. As described above, the core 1 is constructed in advance using the RC construction considering the wind-resistance.

Typically, a tower crane and a concrete distributor are installed in an inner space of the core 1, and core dedicated facilities such as a hoist are installed outside the core 1.

A reinforcing bar 3 is arranged after a system foam is mounted using the core-dedicated facilities, and then a concrete 5 is placed to build the core in advance. Here, an anchor member 7 is buried and installed together when the concrete 5 is placed to prepare the construction of the steel-frame structure. The anchor member 7 includes a connection member 7*a* buried in the concrete 5, an anchor plate 7*b* welded to the connection member 7*a*, and a gusset plate 7*c* welded to the anchor plate 7*b*.

Thereafter, a steel-frame beam 9 is assembled with the gusset plate 7*c* by using high tension bolts 7*d*, and then a slab 11 is built and constructed by installing a slab type mold, arranging reinforcing bars, and placing concrete on the basis of the steel-frame beam 9.

However, in the conventional method for constructing a building using the SRC construction in which the core is firstly build in advance, dedicated facilities such as the hoist and the concrete distributor may be required to arrange the reinforcing bar and place the concrete. In addition, the dedicated facilities should be removed for the installation of the steel frame, the arrangement of the reinforcing bar for slab, and the placing of the concrete, thereby complicating the construction process and increasing the construction costs.

Also, since the advanced core has a small size than that of the residence space defined by the slab, which will be constructed after the core, it is difficult to manage the manpower, manual tool and equipments. Furthermore, the core and the slab should be constructed by separately placing concrete, a reinforcing bar connecting the core to the slab have to be installed in walls in advance, thereby further increasing the construction costs. Also, the separate placement of the concrete is apt to deteriorate the quality of the buildings. In addition, since the working processes for the core and the slab should be done remotely in a vertical direction, the construction process is complicated, and the process, quality, safety managements are difficult.

Particularly, since there is no approaching path to the anchor member for installing the steel frame, the worker may primarily fix the steel frame to a steel-frame column of an outer peripheral portion, and then be moved toward the wall of the core with the help of a life rope installed on a safety rail constructed on the steel frame to secondarily fix the steel frame so as to install the steel frame on the anchor member. As a result, since the working process is cumbersome and the construction period is relatively longer, additional equipment for correcting should be essentially deployed, and safety management may be difficult.

To solve the problems according to the related art, this applicant have applied a construction method in which a core of a building and a steel frame for slab are constructed in advance, and then slab and core concrete are placed together with each other, or the slab concrete is placed in advance and then the core concrete is placed to improve qualities of core and slab structures, improve construction and safety, and reduce construction costs. Also, the construction method applied by this applicant has been patented. In recent, the construction method is being applied in large-scale high-rise build construction sites.

Also, in the conventional SRC structure construction technologies, a core which is prevailing in recent has a pure RC structure, and an outer peripheral portion has a steel-frame structure. Thus, the core should be constructed in advance. There are a conventional core advanced construction method and steel-frame advanced construction method, which is mainly applied to middle or low-rise buildings in the past, in which a steel-frame column and beam are installed in a wall of a core. In case of the core advanced construction method, an angle is previously installed in an RC core wall constructed in advance by using a set anchor to install a deck plate, and then, a deck is installed and concrete is placed. Here, the previously installed angle is not removed. Also, in the steel-frame advanced construction method, an angle is never installed, or since an angle for supporting a slab is welded to a girder, the angle is integrated with concrete after the concrete is cured. As a result, it may be difficult to recycle the angle.

Actually, after the concrete is cured, the angle for supporting the slab may be reduced. However, according to the conventional two methods, since the angle is never installed or is not removed, the angle may be retained. Thus, the construction costs may be increased, and also, it may be difficult to easily install an outer frame of the core for placing the core wall concrete.

DISCLOSURE OF THE INVENTION

Technical Problem

To solve the above-described problems, an object of the present invention is to provide a structure for constructing a high-rise building having a steel-framed reinforced concrete structure in which structural stability in preconstruction of slabs, efficiency in installing a frame to be subsequently constructed, and efficiency in installing angles for supporting the slabs and adjusting the frame assembly position are ensured, and, since the angles are easily removed after slab concrete and core concrete are cured, the angles is recycled.

Another object of the present invention is to provide a structure for constructing a high-rise building having a steel-framed reinforced concrete structure which improves quality of the building, decreases a time required for construction, and reduces construction costs to enable the building to be built more safely.

Technical Solution

In one embodiment, a structure for constructing a high-rise building having a steel-framed reinforced concrete structure and including girders and beams which are horizontally and vertically coupled to each other with respect to a column includes: a gusset plate welded to a side of a first girder or both sides of a second girder and a beam in a direction crossing a length direction of the first girder or in the length direction of the first girder to support at least one angle for supporting a first slab and adjusting a frame assembly position; and a first coupling member including a first bolt and a first nut to couple the angle for supporting the first slab and adjusting the frame assembly position to the gusset plate, wherein the first nut is buried in concrete constituting a core wall or a slab so that the angle for supporting the first slab and adjusting the frame assembly position is separated from the gusset plate after the concrete is cured in a region of the first girder.

According to an aspect of the present invention, the gusset plate may include a first type gusset plate which is welded to the first girder and disposed in a direction crossing the first girder according to orientation of the structure to substantially contact the angle for supporting the first slab and adjusting the frame assembly position, the first type gusset plate including a support plate part supporting the first slab, and the first nut may be disposed on a back surface of the support plate part and buried in the concrete, and the first bolt may be separably coupled to the first but on the angle for supporting the first slab and adjusting the frame assembly position by passing through the angle for supporting the first slab and adjusting the frame assembly position and the support plate part.

According to another aspect of the present invention, the gusset plate may include a welded plate part (a gusset plate) welded in a direction crossing the second girder and the beam according to orientation of the structure to easily install a frame; and a second type gusset plate in which the angle for supporting the first slab and adjusting the frame assembly position is fixed to the welded plate part (the gusset plate), and the first nut may be disposed on a back surface of the welded plate part (the gusset plate) and buried in the concrete, and the first bolt may be separably coupled to the first nut on a front surface of the angle for supporting the first slab and adjusting the frame assembly position by passing the welded plate part (the gusset plate).

According to further another aspect of the present invention, the gusset plate may include a third type gusset plate in which a separate gusset plate for fixing the angle for supporting the first slab and adjusting the frame assembly position to an upper flange of the second girder and the beam is installed separately from a welded plate part (a gusset plate) welded in a direction crossing the second girder and the beam according to orientation of the structure, and the first nut may be disposed on an upper end of the gusset plate installed on the upper flange of the second girder and the beam and buried in the concrete, and the first bolt may be separably coupled to the first but at a lower side of the angle for supporting the first slab and adjusting the frame assembly position by passing through the gusset plate installed on the upper flange of the second girder and the beam.

In an aspect of the present invention, the first bolt and the but for coupling the angle for supporting the first slab and adjusting the frame assembly position to the gusset plate may be coupled in a different direction so that the first bolt passes through the angle for supporting the first slab and adjusting the frame assembly position and the support plate part to allow a heat part of the first bolt to be disposed on the back surface of the support plate part and buried in the concrete, and the first nut is separably coupled to a front end of the first bolt on the front surface of the angle for supporting the first slab and adjusting the frame assembly position.

According to another aspect of the present invention, the gusset plate may include an iron plate having a polygonal shape.

According to further another aspect of the present invention, the first girder or the second girder and the beam May be integrated with the gusset plate.

According to an aspect of the present invention, in the case of the first type gusset plate, the gusset plate welded to the first girder may further include: a support plate part providing a place in which at least one angle for supporting a second slab and adjusting a frame assembly position is coupled at a side thereof; and a second coupling member including a second bolt and a second nut to couple the angle for supporting the second slab and adjusting the frame assembly position to the support plate part.

According to another aspect of the present invention, in the case of the second type gusset plate, the gusset plate welded to both sides of the second girder and the beam may further include: a groove cover plate covering grooves of both sides of the second girder and the beam, the groove cover plate providing a place in which at lest one angle for supporting a second slab and adjusting a frame assembly position is coupled at a side thereof; and a second coupling member including a second bolt and a second nut to couple the angle for supporting the second slab and adjusting the frame assembly position to the groove cover plate.

According to further another aspect of the present invention, in the case of the third type gusset plate, the gusset plate welded to the upper flange of the second girder and the beam may further include: a gusset plate providing a place in which at lest one angle for supporting a second slab and adjusting a frame assembly position is coupled at a side thereof; and a second coupling member including a second bolt and a second nut to couple the angle for supporting the second slab and adjusting the frame assembly position to the gusset plate.

According to further another aspect of the present invention, the second nut may be buried in the concrete so that the angle for supporting the second slab and adjusting the frame assembly position is separated from the groove cover plate after the concrete is cured in regions of the first girder, the second girder, and the slab.

According to further another aspect of the present invention, the second bolt may have a head part disposed on a back surface of the groove cover plate and buried in the concrete so that the angle for supporting the second slab and adjusting the frame assembly position is separated from the groove cover plate after the concrete is cured in regions of the first girder, the second girder, and the slab.

According to further another aspect of the present invention, the structure may further including a cover plate disposed between the second bolt and the angle for supporting the second slab and adjusting the frame assembly position, the cover plate being coupled together with the second bolt and the second nut.

According to an aspect of the present invention, the cover plate may have one end welded and fixed to an end of an inner wall of the angle for supporting the second slab and adjusting the frame assembly position to partially protrude, and a bolt coupling hole facing a through hole defined in an upper portion of the groove cover plate may be defined in the protrusion of the cover plate to couple the second coupling member thereto.

According to another aspect of the present invention, the cover plate may have one end welded and fixed to the slab of the second girder to partially protrude, thereby coupling the angle for supporting the second slab and adjusting the frame assembly position to a portion adjacent to the groove cover plate, and a bolt coupling hole facing a through hole defined in an upper end of the angle for supporting the second slab and adjusting the frame assembly position may be defined in the protrusion of the cover plate to couple the second coupling member thereto.

According to further another aspect of the present invention, the cover plate may be welded and fixed to a side surface of the slab of the second girder to protrude, thereby coupling the angle for supporting the second slab and adjusting the frame assembly position to a portion adjacent to the groove cover plate, and a bolt coupling hole facing a through hole defined in an upper end of the angle for supporting the second slab and adjusting the frame assembly position may be defined in the protrusion of the cover plate to couple the second coupling member thereto.

According to further another aspect of the present invention, the structure may further include an angle for adjusting a frame assembly position which is welded to a lower end of the groove cover plate to adjust an assembly position with the other girder or the other beam.

According to further another aspect of the present invention, the second girder, the groove cover plate, and the angle for adjusting the fame assembly position may be integrated with each other.

Advantageous Effects

According to the present invention, structural stability in the preconstruction of the slabs, efficiency in installing the frame to be subsequently constructed, and efficiency in installing the angles for supporting the slabs and adjusting the frame assembly position can be ensured. Furthermore, since the angles can be easily removed after the slab concrete and core concrete are cured, the angles can be recycled, thus improving the quality of the building, decreasing the time required for construction, and reducing construction costs, and enabling the building to be built more safely.

DESCRIPTION OF SYMBOL

Figure 1:
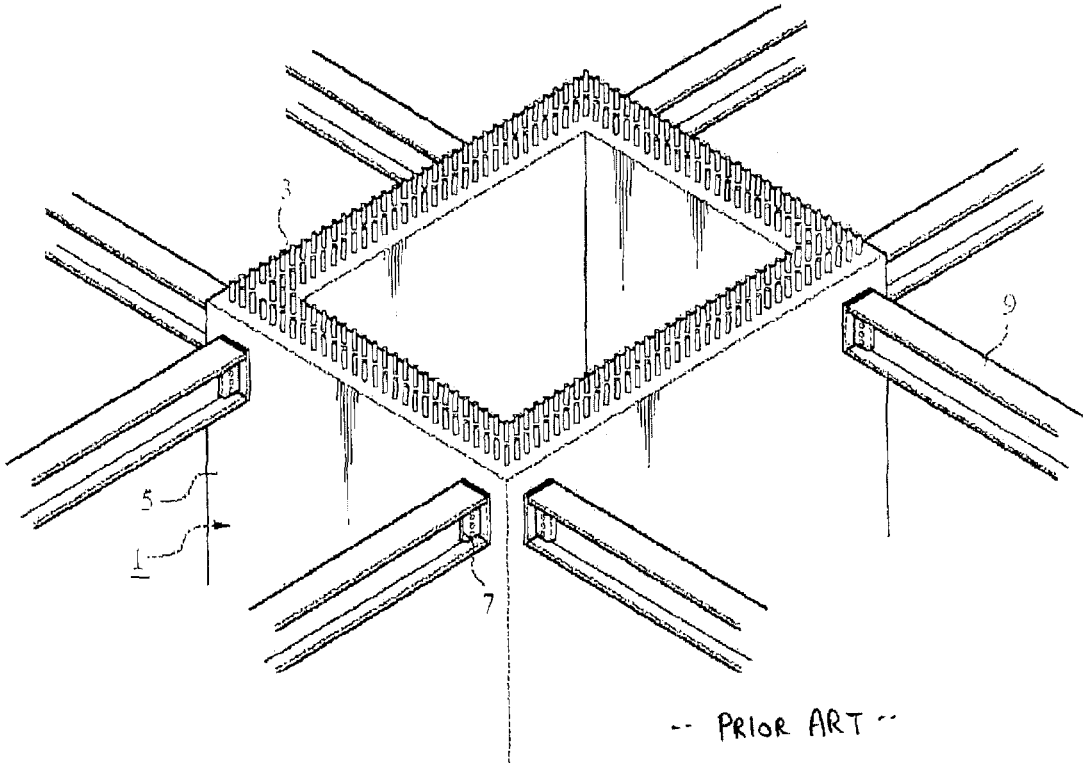
FIG. 1 is a perspective view of a structure for constructing a high-rise building according to a related art.
Figure 2:
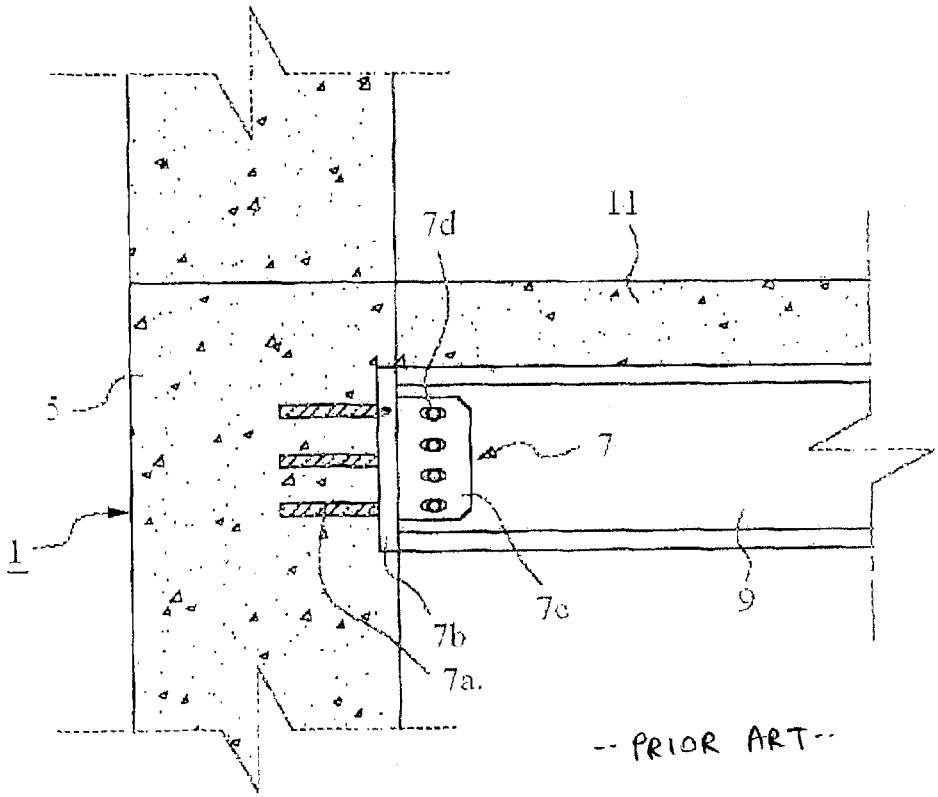
FIG. 2 is a cross-sectional view of a steel-frame beam connection structure according to the related art.

1: Core
10: Column
20,21: Beam
31,32,33: Girder
41,42: Angle for supporting slab and adjusting frame assembly position
45: Angle for adjusting frame assembly position
33*a*,50: Gusset plate
51: Welded plate part (gusset plate)
52: Support plate part
60: First coupling member
70: Groove cover plate
77: Cover plate
80: Second coupling member

BEST MODE FOR CARRYING OUT THE INVENTION

Exemplary embodiments of the present invention will be described below in more detail with reference to the accompanying drawings.

Figure 4:
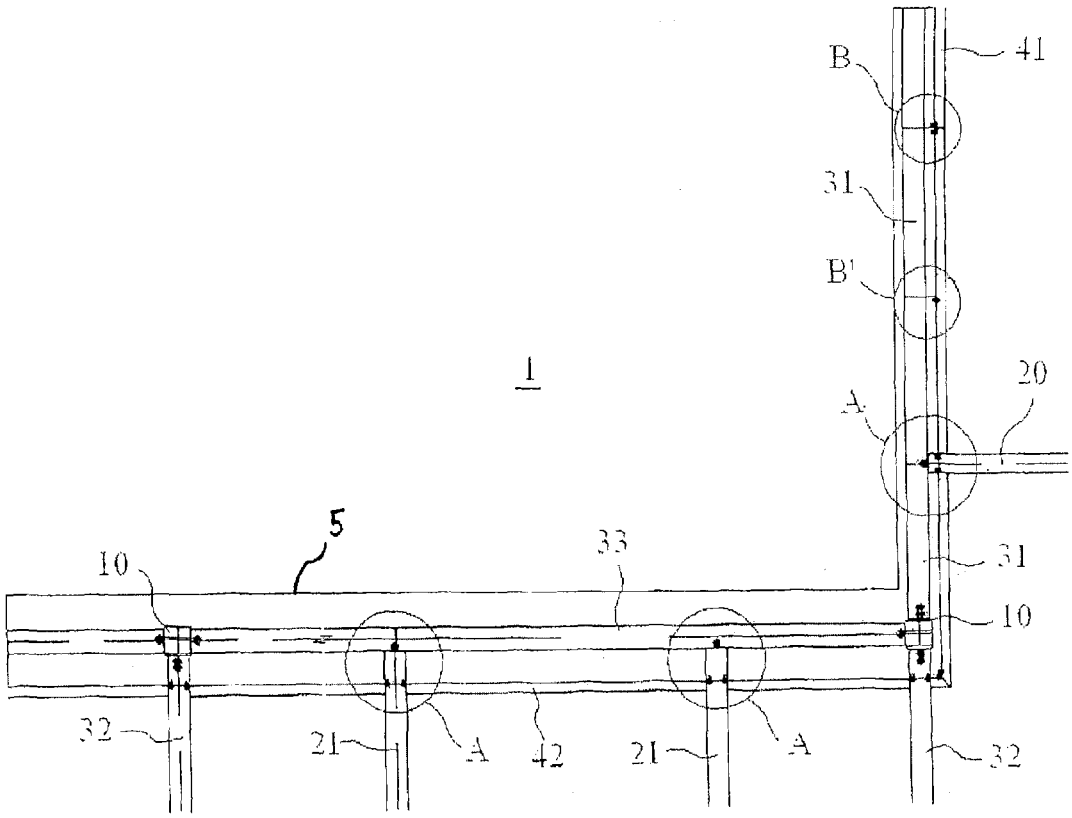
FIG. 4 is a view of a state in which concrete of FIG. 3 is cured.
Figure 3:
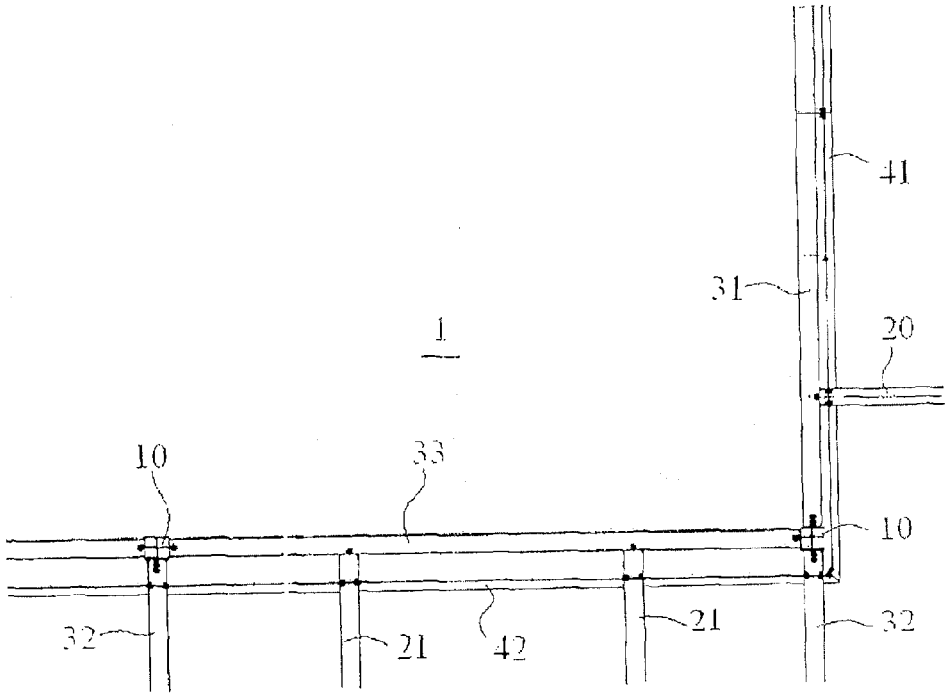
FIG. 3 is a partial plan view of a structure for constructing a high-rise building having a steel-framed reinforced concrete according to an embodiment of the present invention.
Figure 5:
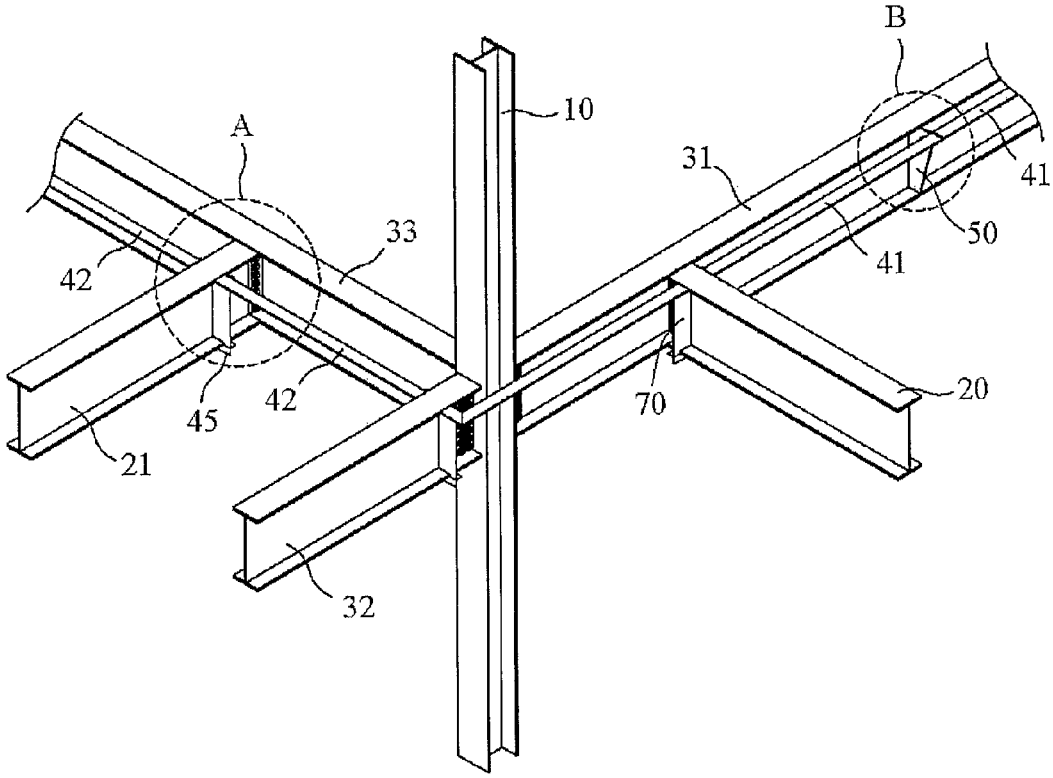
FIG. 5 is a schematic perspective view of FIG. 3.

FIG. 3 is a partial plan view of a structure for constructing a high-rise building having a steel-framed reinforced concrete according to an embodiment of the present invention. FIG. 4 is a view of a state in which concrete 5 of FIG. 3 is cured. FIG. 5 is a schematic perspective view of FIG. 3.

Referring to FIGS. 3, 4, and 5, in a construction structure according to the current embodiment, steel frames 10, 31, 33 and steel frames 20, 21, and 32 for slab which are buried in a wall of a core 1 of a building are constructed in advance. Then, a slab and core concrete 5 are placed together, or the slab concrete 5 is previously placed, and then the core concrete 5 is placed. Thus, the structures of the core 1 and slab may be improved in quality and safety and reduced in construction costs.

However, unlike the related art, angles 41 and 42 for supporting first and second slabs may be easily installed. In addition, the angles 41 and 42 for supporting the first and second slabs and adjusting a frame assembly position may be easily removed after concrete 5 toward the core 1 or slabs is cured. Thus, the angles 41 and 42 may be recycled to reduce construction costs.

FIGS. 3 and 5 are plan and perspective views illustrating a state before the concrete 5 is placed to form the core 1. FIG. 4 is a view illustrating a state in which the concrete 5 is placed. Also, for convenience, FIGS. 3 to 5 illustrate a state of which a side is cut.

Referring to FIG. 5, in the structure for constructing the building according to the current embodiment, a plurality of girders, i.e., first to third girders 31, 32, and 33 are coupled to each other in a horizontal or vertical direction with respect to a plurality of columns 10 which are disposed vertically to define an outer appearance.

Here, each of the most columns 10 and plurality of first to third girders 31, 32, and 33 may have an H-beam shape. Also, as occasion demands, a beam 20 having a load relatively less than those of the column 10 and the first to third girders 31, 32, and 33 may be used to constitute one building.

When the plurality of first to third girders 31, 32, and are vertically or horizontally coupled to each other with respect to the columns 10, the angles 41 and 42 for supporting the first and second slabs and adjusting the frame assembly position should be assembled for each position of the plurality of first to third girders 31, 32, and 33 and the first and second beams 20 and 21. Also, after the concrete is cured, the angles 41 and 42 for supporting the first and second slabs and adjusting the frame assembly position should be removed. Thus, the construction structure different from an existing construction structure may be required. This will be described with reference to the following accompanying drawings.

Figure 6:
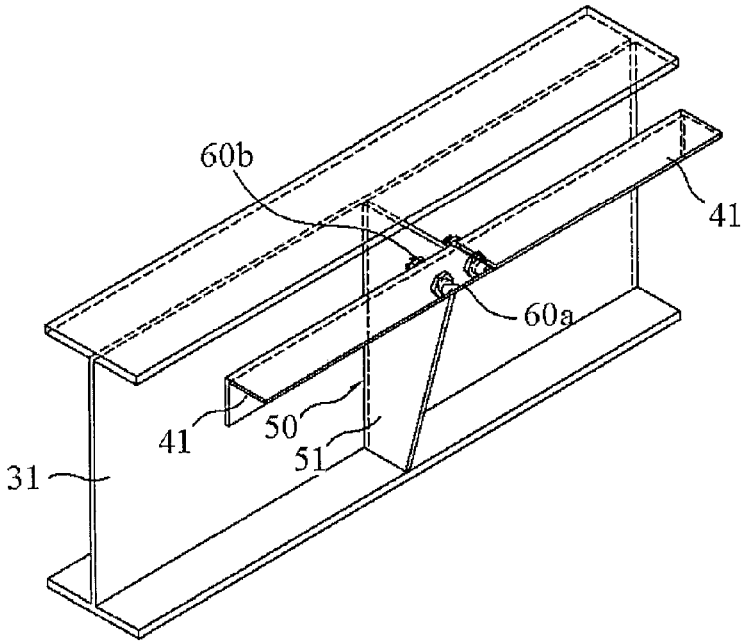
FIG. 6 is an enlarged perspective view of a region B of FIG. 5.
Figure 7:
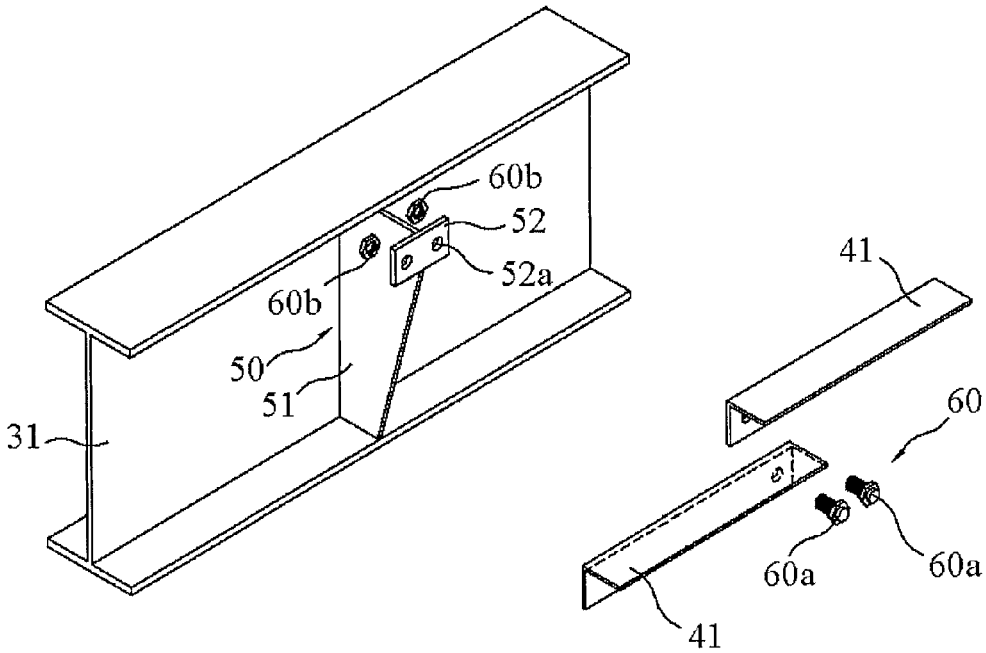
FIG. 7 is an exploded perspective view of FIG. 6.
Figure 9:
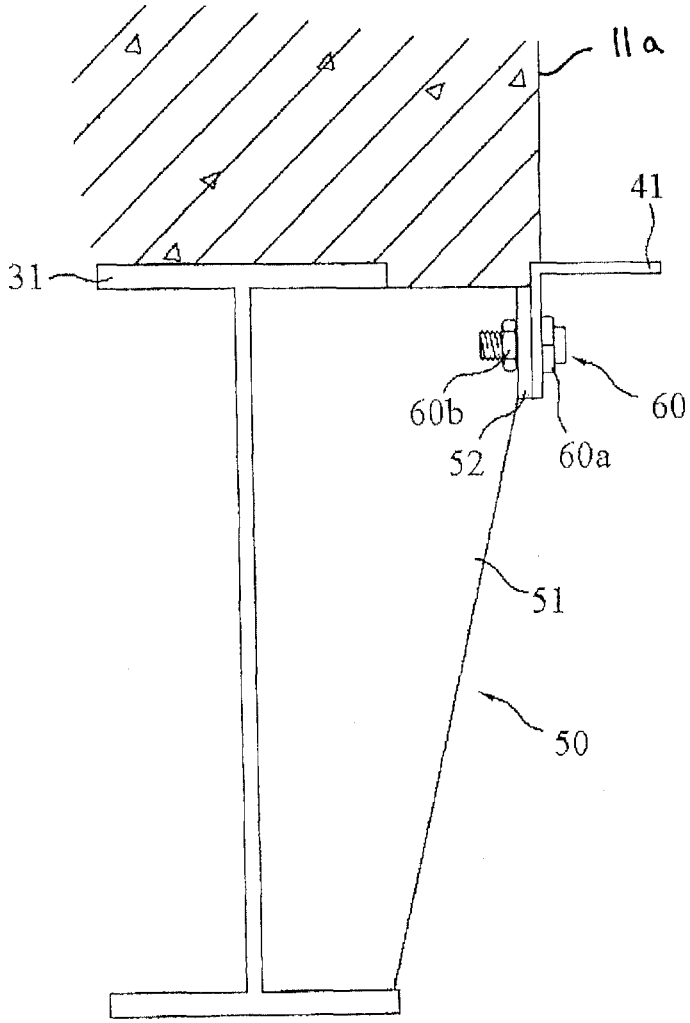
FIG. 9 is a side view of a structure of FIG. 6.

FIG. 6 is an enlarged perspective view of a region B of FIG. 5. FIG. 7 is an exploded perspective view of FIG. 6. FIG. is an enlarged perspective view of the region B of FIG. 5 according to another embodiment. FIG. 9 is a side view of a structure of FIG. 6 including a first slab 11*a*.

As shown in FIGS. 6 to 9, a gusset plate 50 is integrally welded to the first girder 31. That is, the gusset plate 50 is welded to the first girder 31 in a direction crossing a length direction of the first girder 31 to support the angle 41 for supporting the first slab and adjusting the frame assembly position.

The gusset plate 50 includes a welded plate part (a gusset plate) 51 welded to the first girder 31 and a support plate part 52 disposed in a direction crossing the welded plate part (the gusset plate) 51 and substantially contacting the angle 41 for supporting the first slab 11*a* and adjusting the frame assembly position to support the angle 41 for supporting the first slab 11*a* and adjusting the frame assembly position.

The welded plate part (the gusset plate) 51 may have an iron plate having a polygonal shape. In the current embodiment, the welded plate part (the gusset plate) 51 may be looked as if a trapezoid shape. However, the present invention is not limited to the shape of the welded plate part (the gusset plate) 51. For example, the welded plate part (the gusset plate) 51 may have various shapes.

Figure 8:
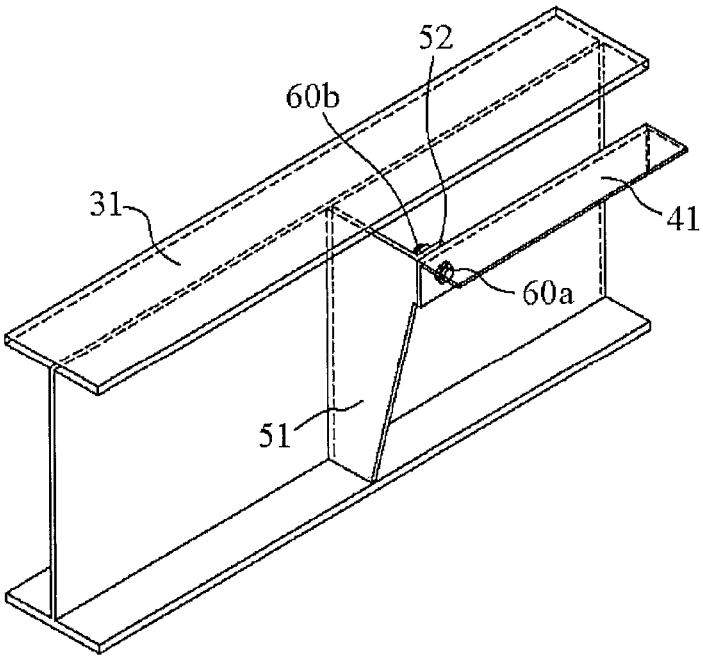
FIG. 8 is an enlarged perspective view of the region B of FIG. 5 according to another embodiment.

A plurality of holes 52*a* is defined in the support plate part 52. Although the support plate part 52 has a structure bilaterally symmetric to each other with respect to the welded plate part (the gusset plate) 51 as shown FIG. 7, the present invention is not limited thereto. For example, as shown in FIG. 8, the support plate part 52 may be disposed on only a side, and also be adequately adjusted in structure according to the position thereof.

MODE FOR THE INVENTION

That is to say, if the support plate part 52 is disposed at a position for supporting a continuous middle portion of the angle 41 for supporting the first slab 11*a* and adjusting the frame assembly position to prevent the angle 42 from being deflected, the support plate part 52 bent in one direction may be installed. On the other hand, if the support plate part 52 is disposed at a position for connecting ends of the angle 41 for supporting the first slab 11*a* and adjusting the frame assembly position to each other to continuously maintain the angle 41, the support plate part 52 having wing portions expanded in both directions may be installed.

Also, the first girder 31 and the gusset plate 50 may be provided as an integrated product. Also, the product may be previously manufactured in factories or be assembled in a site.

Due to the above-described structure, a first coupling member 60 for coupling (or assembling) the angle 41 for supporting the first slab 11*a* and adjusting the frame assembly position to the gusset plate 50 may be provided on the first girder 31 integrated with the gusset plate 50.

Figure 16:
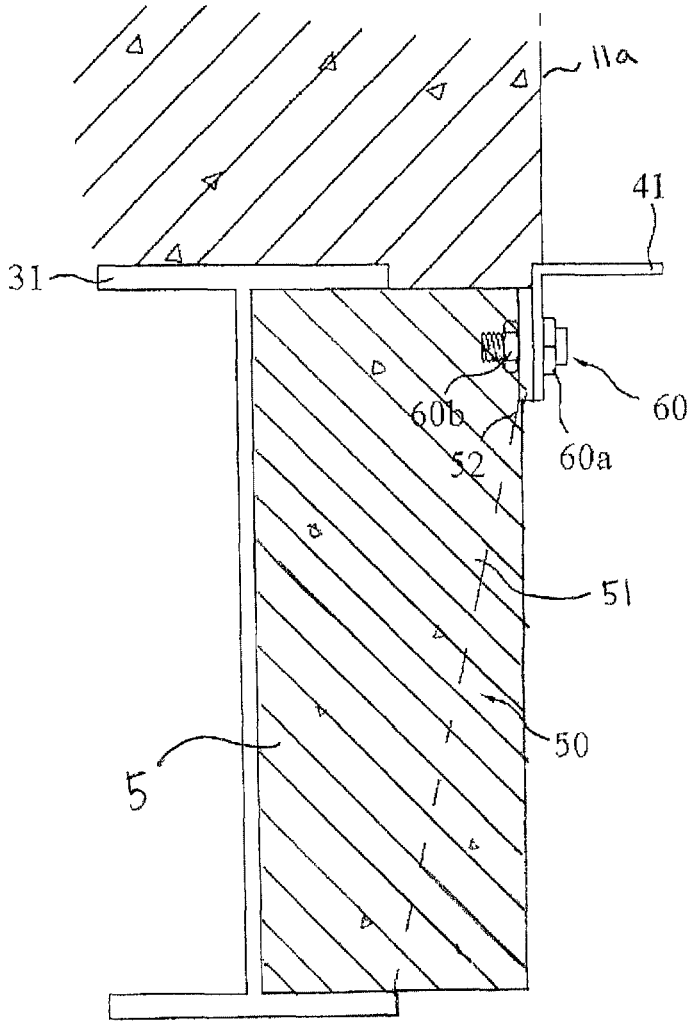
FIG. 16 is a further view of a structure of FIG. 9 in which concrete is cured.
Figure 17:
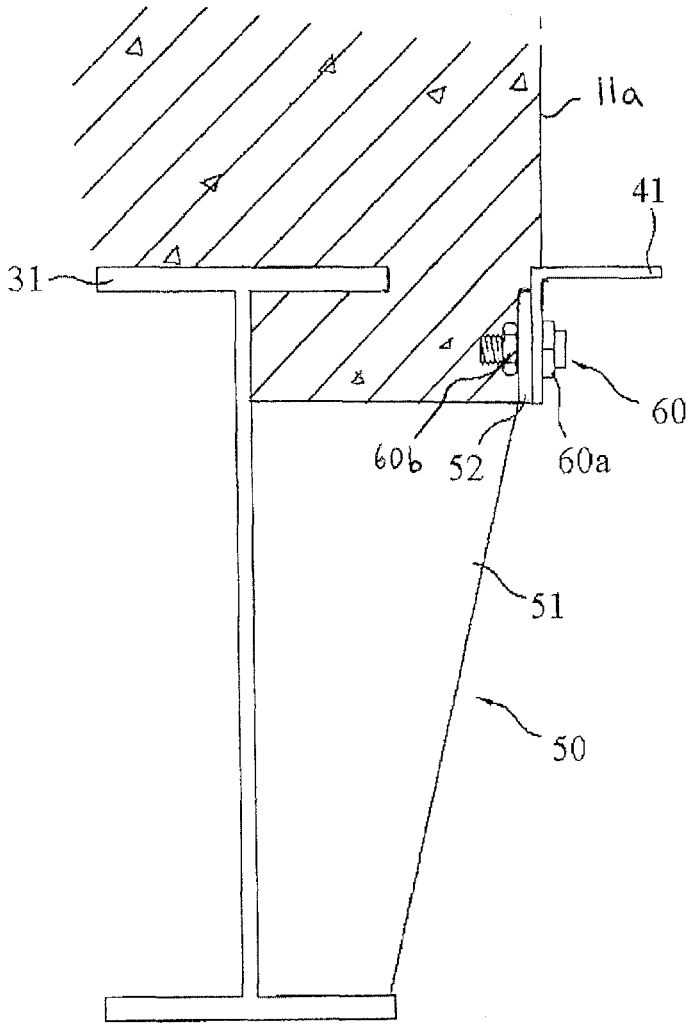
FIG. 17 is an additional view of a structure of FIG. 9 having an alternative first slab.

The first coupling member 60 may be constituted by a combination of a first bolt 60*a* and a first nut 60*b* which are angled typically. The first nut 60*b* may be coupled to be buried in the core concrete (as shown in FIG. 16 where the first nut 60*b* is buried in concrete 5 which may be part of a core 1) so that the angle 41 for supporting the first slab 11*a* and adjusting the frame assembly position is separated from the gusset plate 50 when the first bolt 60*a* is separated from the first nut 60*b* after the concrete is cured. Alternatively, the first nut 60*b* may be coupled to be buried in the first slab 11*a* as shown in FIG. 17.

Here, the first nut 60*b* is disposed on a back surface of the support plate part 52. Also, the first bolt 60*a* may be separably coupled to the first nut 60*b* on a front surface of the angle 41 for supporting the first slab and adjusting the frame assembly position by passing through the angle 41 for supporting the first slab and adjusting the frame assembly position.

Referring again to FIG. 9, the angle 41 for supporting the first slab 11*a* and adjusting the frame assembly position may be disposed on the support plate part 52 of the gusset plate 50.

Then, the first bolt 60*a* may pass through the angle 41 for supporting the first slab and adjusting the frame assembly position and the support plate part 52 and then be coupled to the first nut 60*b* on the front surface of the angle 41 for supporting the first slab 11*a* and adjusting the frame assembly position. Thus, the angle 41 for supporting the first slab and adjusting the frame assembly position may be easily assembled.

Thereafter, a frame is assembled, and concrete 5 is cured to construct the core 1. Thus, since the angled first bolt 60*a* is separated using a tool after the concrete 5 is cured, the angle 41 for supporting the first slab 11*a* and adjusting the frame assembly position may be removed anytime as occasion demands and recycled.

In a case of the second girder 32 constructed using a method different from that of the first girder 31 and the first beam 20, the second girder 32 may have a structure different from that of the first girder 31. This will be described with reference to FIGS. 10 to 15.

Figure 10:
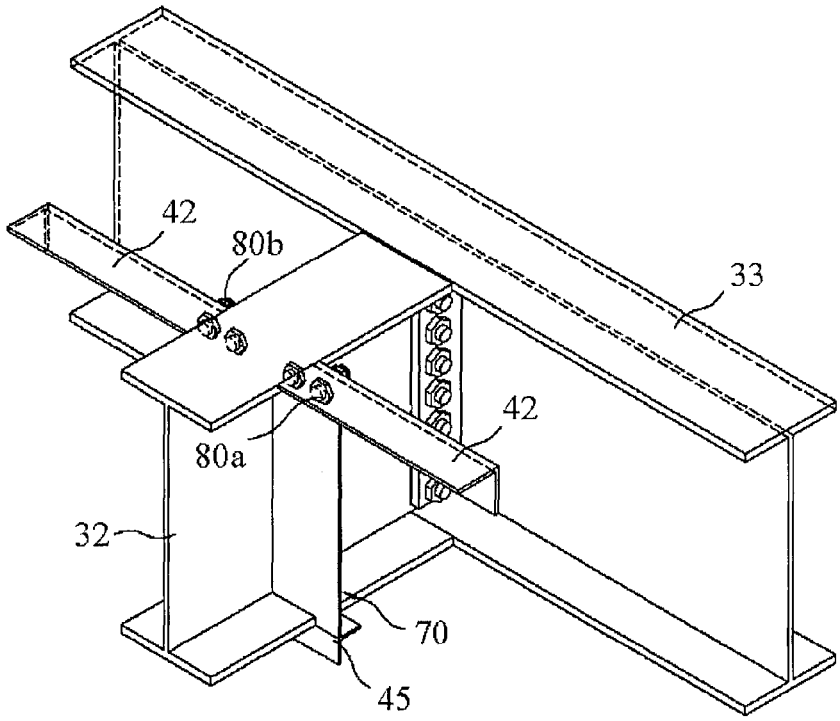
FIG. 10 is an enlarged perspective view of a region A of FIG. 5.
Figure 11:
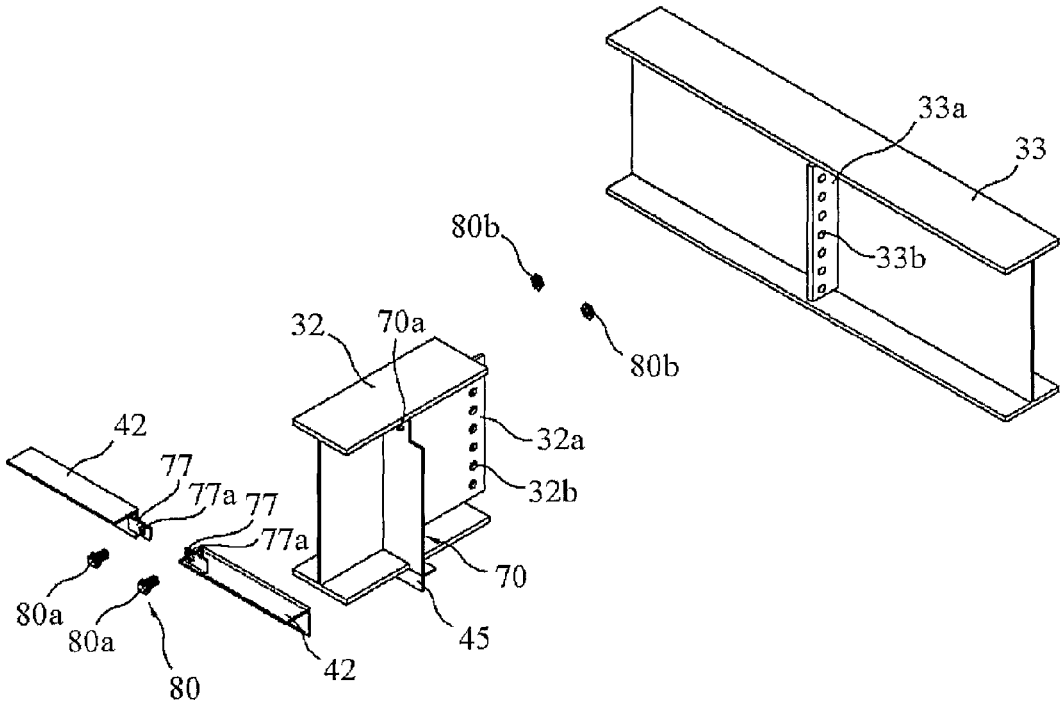
FIG. 11 is an exploded perspective view of FIG. 10.
Figure 12:
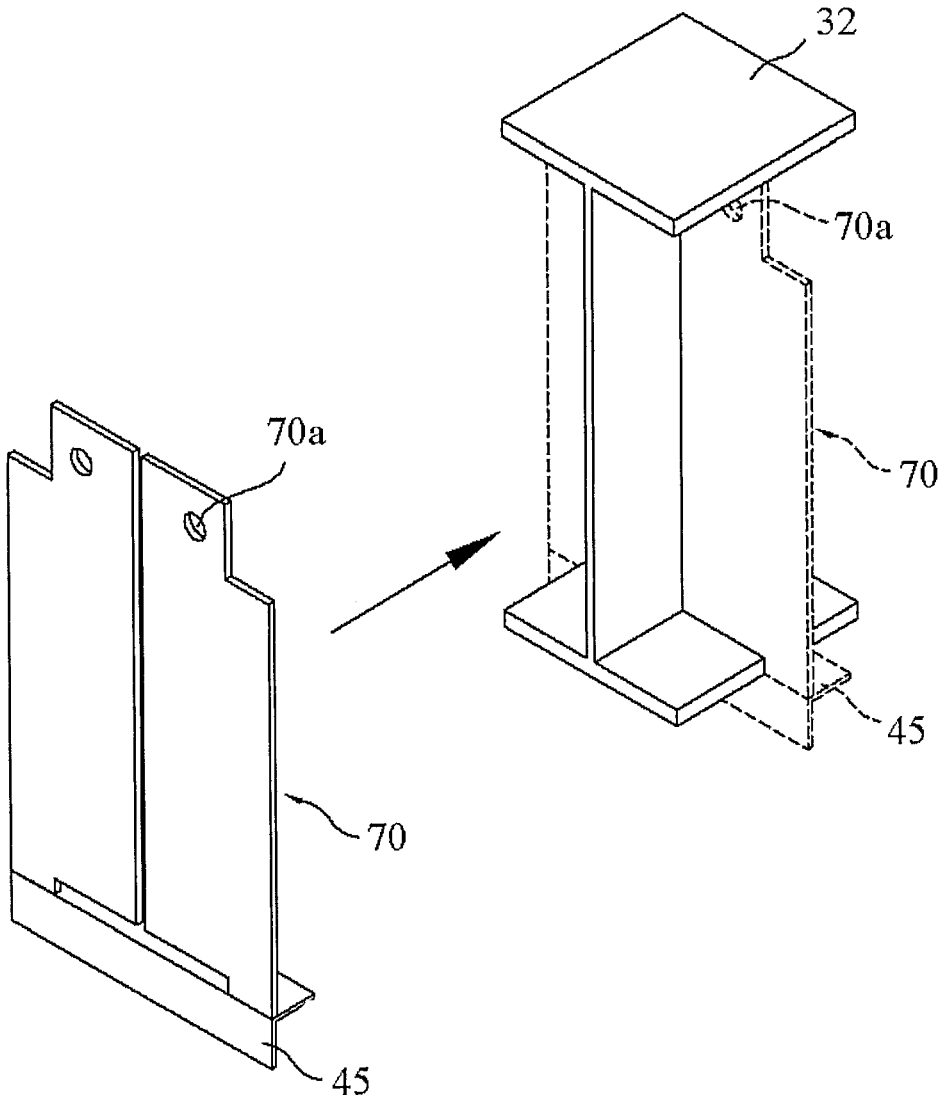
FIG. 12 is an enlarged perspective view of a main part of FIG. 11.
Figure 13:
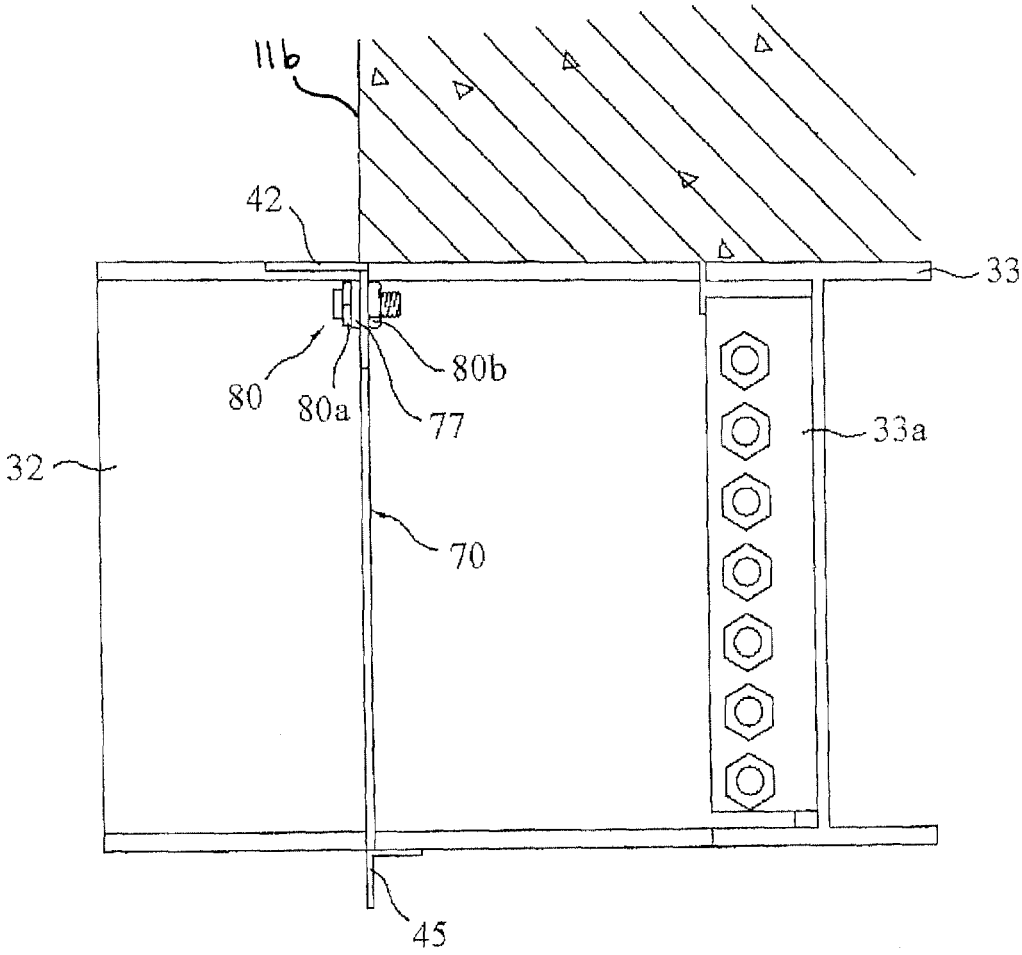
FIG. 13 is a side view of a structure of FIG. 10.

FIG. 10 is an enlarged perspective view of a region A of FIG. 5. FIG. 11 is an exploded perspective view of FIG. 10. FIG. 12 is an enlarged perspective view of a main part of FIG. 11. FIG. 13 is a side view of a structure of FIG. 10.

Referring to FIGS. 10 to 13, a groove covering plate 70 welded to both sides of the second girder 32 and the first beam 20 to partially cover grooves of both sides of the second girder 32 and the first beam 20 which respectively have H-beam shapes and providing a place in which the angle 42 for supporting a second slab 11*b* and adjusting the frame assembly position is coupled at a side thereof is welded to the second girder 32 and the first beam 20.

Also, an angle 45 for adjusting a frame assembly position may be further welded to a lower end of the groove cover plate 70.

As a result, the second girder 32 or the first beam 20, the groove cover plate 70, and the angle 45 for adjusting the frame assembly position may be provided as an integrated product. Also, the product may be previously manufactured in factories or be assembled in a site. The integrated product constituted by the second girder 32 or the first beam 20, the groove cover plate 70, and the angle 45 for adjusting the frame assembly position is shown as a dotted line of FIG. 12.

A second coupling member 80 is provided in the same method as that of the above-described first coupling member 60 to couple an angle 42 for supporting the second slab and adjusting the frame assembly position to the groove cover plate 70 integrated with the second girder 32 and the first beam 20.

The second coupling member 80 may be constituted by a combination of a second bolt 80*a* and a second nut 80*b* which are angled typically. In the current embodiment, the second nut 60*b* may be coupled to be buried in the core concrete so that the angle 42 for supporting the second slab and adjusting the frame assembly position is separated from the groove cover plate 70 when the second bolt 80*a* is separated from the second nut 80*b* after the concrete is cured.

Here, the second nut 80*b* is disposed on a back surface of the groove cover plate 70. Also, the second bolt 80*a* may be coupled to the second nut 80*b* on a cover plate 77 attached to the angle 42 for supporting the second slab and adjusting the frame assembly position by passing through the groove cover plate 70.

Referring to FIG. 13, the angle 42 for supporting the second slab and adjusting the frame assembly position to which the cover plate 77 is attached is disposed on a front surface of the groove cover plate 70. Then, the second bolt 80*a* may pass through the groove cover plate 70 from the front surface of the cover plate 77 attached to the angle 42 for supporting the second slab 11*b* and adjusting the frame assembly position to couple the second nut 80*b* thereto, thereby easily assembling the angle 42 for supporting the second slab 11*b* and adjusting the frame assembly position.

FIGS. 10 to 13 illustrate a structure in which one end of the cover plate 77 is welded and fixed to an end of an inner wall of the angle 42 for supporting the second slab and adjusting the frame assembly position to partially protrude, and a bolt coupling hole 77*a* facing a through hole 70*a* defined in an upper portion of the groove cover plate 70 is defined in the protrusion of the cover plate 77 so that the second coupling member 80 is coupled according to an embodiment of the present invention.

Figure 14:
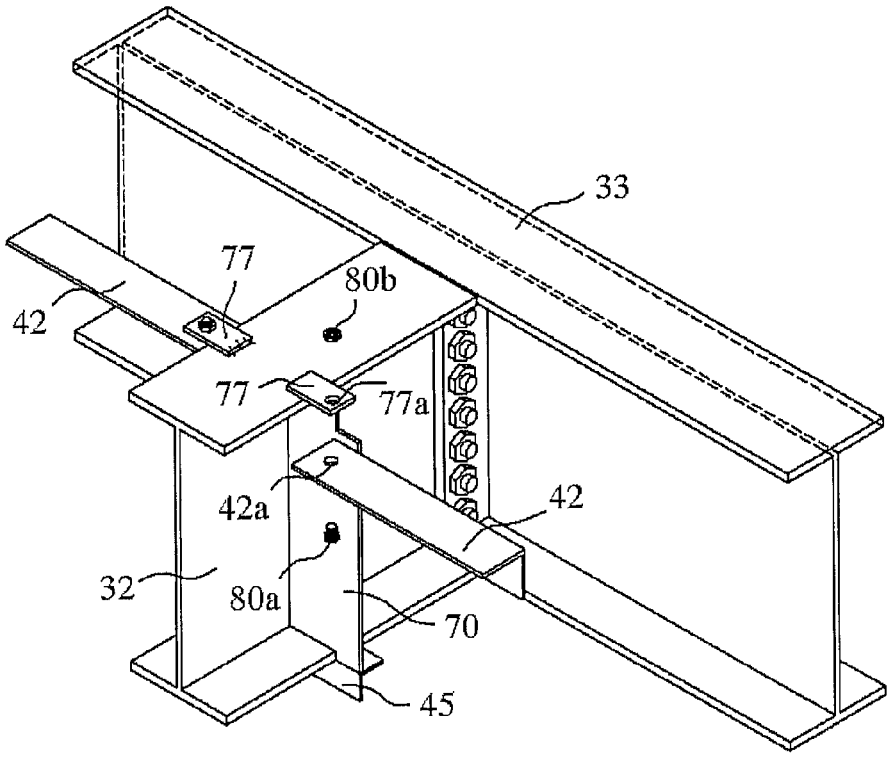
FIG. 14 is an enlarged perspective view of the region A of FIG. 5 according to another embodiment.
Figure 15:
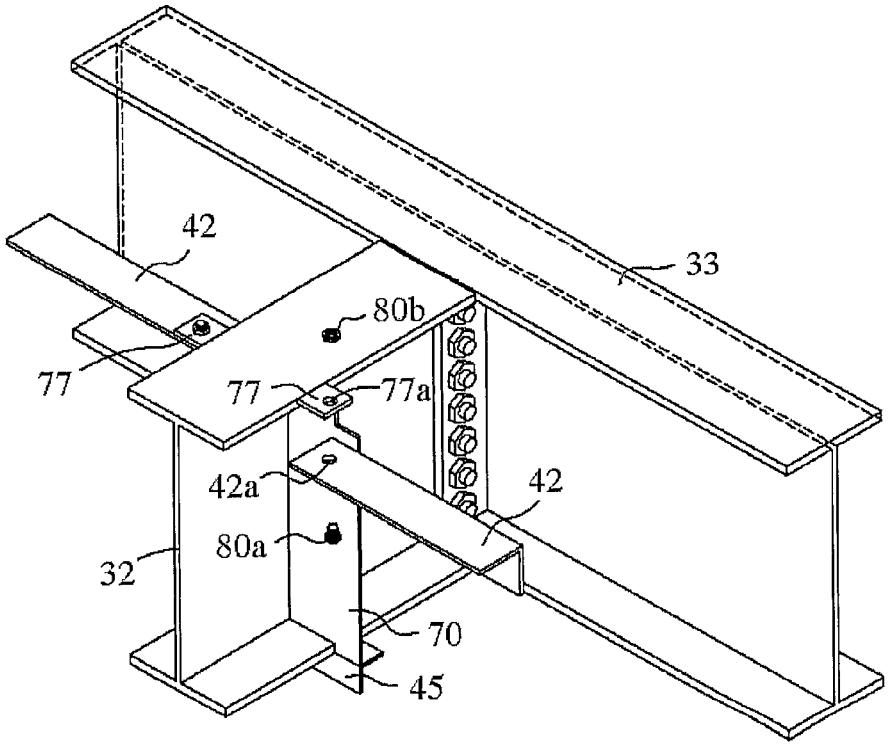
FIG. 15 is an enlarged perspective view of the region A of FIG. 5 according to further another embodiment.

However, referring to FIG. 14 according to another embodiment of the present invention, an end of the cover plate 77 is overlappingly welded to the slab of the second girder 32 to partially protrude so that the angle 42 for supporting the second slab 11*b* and adjusting the frame assembly position is coupled to a portion adjacent to the groove cover plate 70. Also, a bolt coupling hole 77*a* facing a through hole 42*a* punched in an end of an upper portion of the angle 42 for supporting the second slab 11*b* and adjusting the frame assembly position is defined in the protrusion of the cover plate 77 exposed to the outside of the slab to stably couple the second coupling member 80. Referring to FIG. 15 according to further another embodiment of the present invention, the cover plate 77 is welded and fixed to a side surface of the slab of the second girder 32 to protrude. In this case, the purpose of the present invention may be effectively obtained also.

Here, the second bolt 80*a* may be exposed to the outside so that the angle 42 for supporting the second slab and adjusting the frame assembly position are easily separated from the groove cover plate 70 after the concrete is cured in the slab region of the first to third girders 31, 32, and 33.

Thereafter, a frame is assembled, and concrete is cured to construct the core 1. Thus, since the angled second bolt 80*a* is separated using a tool after the concrete is cured, the angle for supporting the second slab and adjusting the frame assembly position may be removed anytime as occasion demands and recycled.

The second girder 32 integrated with the groove cover plate 70 and an angle 45 for adjusting the frame assembly position and the first beam 20 are constructed with a predetermined gap along a circumference direction of the core 1.

Referring to the exploded perspective view of FIGS. 5 and 11, the first girder 31, a first column 10, the third girder 33 which respectively cross the first beam 20, the second girder 32, and the second beam 21 may be assembled with each other by assembling the bolts in a state where a separate gusset plate 33*a* is welded to the first girder 31, the first column 10, and the third girder 33 to allow a hole 33*b* of the gusset plate 33*a* to accord with a hole 32*b* defined in a protrusion end 32*a* of the second girder 32. For convenience of the bolt assembly, one of the holes 33*b* and 32*b* may have a long hole shape.

Due to the above-described construction structure, the angles 41 and 42 for supporting the slabs and adjusting the frame assembly position may be easily installed. In addition, the girder connected to the core and the frame around the beam may be easily finished, and the angles 41 and 42 for supporting the slabs and adjusting the frame assembly position may be easily removed after the core concrete is cured. Thus, the angles 41 and 42 may be recycled to reduce the construction costs.

INDUSTRIAL APPLICABILITY

The present invention may not be construed as limited to the embodiments set forth herein, and it will be understood by those skilled in the art that various changes in form and details may be made therein without departing from the spirit and scope of the invention as defined by the appended claims. Therefore, these changes and modifications of the invention will be construed as being included in scopes of claims.

The invention claimed is:

1. A structure used in constructing a high-rise building having a steel-framed reinforced concrete structure in which a frame assembly is constructed and installed therein, the concrete structure including girders and a column, each of the girders being coupled to one of the column and another one of the girders, the structure comprising:

a gusset plate welded to one of (a) a face of a side of a first one of the girders in a first direction crossing a length of the first girder substantially parallel to the column, the gusset plate extending away from the face of the first girder and (b) opposing faces of a side of a second one of the girders in a second direction crossing a length of the second girder substantially parallel to the column, the gusset plate supporting at least one angle for supporting a first slab and adjusting a frame assembly position; and a first coupling member including a first bolt and a first nut to couple the angle to the gusset plate, wherein the first nut is buried in concrete constituting a core wall or the first slab so that the angle is separable from the gusset plate after the concrete is cured in a region of the first girder or the second girder.

2. The structure of claim 1, wherein the gusset plate which is welded to the face of the side of the first girder includes a support plate part configured to engage coupling member, and the first nut is disposed on a back surface of the support plate part and buried in the concrete, and the first bolt passes through the angle and a front surface of the support plate part to separably couple to the first nut.

3. The structure of claim 2, wherein the support plate part includes a first portion to which the first coupling member engages, the support plate part including a second portion extending from the first portion to which a further angle is supported via a second coupling member, the second coupling member including a second bolt and a second nut.

4. The structure of claim 1, wherein the gusset plate which is welded to the opposing faces of the side of the second girder including a cover plate configured to engage the first coupling member to couple the angle to the gusset plate, the cover plate positioned on one of the opposing faces of the side of the second girder, and the first nut is disposed on a back surface of the first cover plate and buried in the concrete, and the first bolt pass through the angle and a front surface of the groove cover plate to separably couple to the first nut.

5. The structure of claim 4, wherein the gusset plate further including a further cover plate configured to engage a second coupling member including a second bolt and a second nut to couple a further angle to the gusset plate, the further cover plate positioned on the other opposing face of the side of the second girder.

6. The structure of claim 5, wherein the second nut is buried in the concrete so that the angle is separable from the gusset plate after the concrete is cured in the region of the second girder.

7. The structure of claim 5, wherein the second girder, the cover plate, the further cover plate, and the angle are integrated with each other.

8. The structure of claim 5, wherein the cover plate and the further cover plate each have a first end welded and fixed to the angle and the further angle, respectively, a second end of the cover plate and the further cover plate protruding away from the angle and the further angle, respectively, the second end of the cover plate and the further cover plate each including a bolt coupling hole configured for the first bolt and the second bolt, respectively, to pass therethrough.

9. The structure of claim 1, wherein the gusset plate which is welded to the opposing faces of the side of the second girder including a cover plate configured to engage the first coupling member, the cover plate positioned on a second side of the second girder in a direction perpendicular to the second direction, and the first nut is disposed on an upper side of the first cover plate and buried in the concrete, and the first bolt passes through the angle and a lower side of the cover plate to separably couple to the first nut.

10. The structure of claim 9, wherein the cover plate is positioned on the second side of the second girder adjacent one of the opposing faces of the side of the second girder, the gusset plate further including a further cover plate configured to engage a second coupling member including a second bolt and a second nut to couple a further angle to the gusset plate, the further cover plate positioned on the second side of the second girder adjacent the other of the opposing faces of the side of the second girder.

11. The structure of claim 10, wherein the second bolt has a head part disposed on a back surface of the cover plate and buried in the concrete so that the angle is separable from the gusset plate after the concrete is cured in the region of the second girder.

12. The structure of claim 10, wherein the cover plate and the further cover plate each have a first end welded and fixed to the second side of the second girder, a second end of the cover plate and the further cover plate protruding away from the second side of the second girder, the second end of the cover plate and the further cover plate each including a bolt coupling hole configured for the first bolt and the second bolt, respectively, to pass therethrough when the angle and the further angle are respectively coupled to the gusset plate.

13. The structure of claim 1, wherein the gusset plate which is welded the face of the first girder including a support plate configured to engage the first coupling member, and the first bolt includes a head part disposed on a back surface of the support plate and buried in the concrete, and the first bolt passes through the back surface of the support late and the angle to separably couple to the first nut disposed on a front surface of the support plate.

14. The structure of claim 1, wherein the gusset plate including an iron plate having a polygonal shape.

15. The structure of claim 1, wherein at least one of the first girder and the second girder are integrated with the gusset plate.

* * * * *